United States Patent [19]

Goto

[11] Patent Number: 4,984,695

[45] Date of Patent: Jan. 15, 1991

[54] WHEEL CRANE

[75] Inventor: Hideki Goto, Kobe, Japan

[73] Assignee: Kabushiki Kaisha Kobe Seiko Sho, Kobe, Japan

[21] Appl. No.: 407,281

[22] Filed: Sep. 14, 1989

[51] Int. Cl.[5] ..... B66C 23/04

[52] U.S. Cl. ..... 212/231; 212/232; 212/264

[58] Field of Search ..... 212/187, 230, 231, 264, 212/182, 232, 240

[56] References Cited

U.S. PATENT DOCUMENTS

| | | | |
|---|---|---|---|
| 3,236,393 | 2/1966 | Girardi | 212/231 |
| 3,620,579 | 11/1971 | Brown | 212/231 |
| 3,721,350 | 3/1973 | Nephew | 212/231 |
| 4,194,639 | 3/1980 | Grove | 212/187 |

FOREIGN PATENT DOCUMENTS

| | | | |
|---|---|---|---|
| 1440071 | 4/1965 | France | 212/231 |

*Primary Examiner*—Sherman Basinger
*Assistant Examiner*—Thomas J. Brahan
*Attorney, Agent, or Firm*—Oblon, Spivak, McClelland, Maier and Neustadt

[57] ABSTRACT

A wheel crane wherein the maximum radius of pivotal motion of a boom is minimized and the boom foot mounting point can be positioned as rearwards as possible to realize an increase of the boom length. The wheel crane comprises a lower running body, an upper pivotal body, a boom mounted for up and down pivotal motion around a boom foot pin on the upper pivotal body, at least two winch drums and guide sheaves disposed at rear locations of the pivotal body. The boom foot pin is mounted at an end portion of the base end portion of the boom on the rear face side of the boom and at a location of the upper pivotal body rearwardly of the center of a rear axle of the lower running body. The guide sheaves and winch drums are mounted in a left and right juxtaposed relationship on the upper pivotal body nearest to the base end of the boom within a range wherein they are not contacted with the base end of the boom when the boom is pivoted upwardly, and the locations of rear ends of the two guide sheaves are substantially coincident to the position of the rear end of the upper pivotal body in the forward and backward directions.

3 Claims, 3 Drawing Sheets

WHEEL CRANE

BACKGROUND OF THE INVENTION

1. Field of the Invention

This invention relates to a wheel crane such as a rough terrain crane.

2. Description of the Prior Art

An exemplary one of conventional cranes is shown in FIG. 3.

Referring to FIG. 3, the crane shown is a rough terrain crane and includes a lower running body 1, an upper pivotal body 2 carried on the lower running body 1, and a telescopic boom 3 mounted for pivotal up and down movement around a boom foot pin 3*a* on the upper pivotal body 2.

The upper pivotal body 2 includes a main frame 2*a* and a winch frame 2*b*, and a base end portion of the telescopic boom 3 (boom foot) is mounted for pivotal motion at a rear end portion of the main frame 2*a* by means of the boom foot pin 3*a*. Meanwhile, a pair of winch drums 4 and 5 are disposed in an offset condition in the forward and backward directions in the inside of the winch frame 2*b*, and a pair of guide sheaves 6 and 7 for guiding ropes $R_1$ and $R_2$ drawn out from the drums 4 and 5 to the rear face side of the boom 3 by way of the base end side of the boom 3 are disposed in a corresponding relationship above the winch drums 4 and 5, respectively. A counterweight 8 is mounted on a rear end face of the winch frame 2*b*.

With such a wheel crane as described above, it is desired to employ an elongated boom in order to increase the operation capacity, but since the extent of a forward extension of the boom 3 when the wheel crane runs on a public road is restricted by regulation, the length of the boom cannot be made long without restriction. Thus, it may be advisable to position, as means for making the length of the boom 3 as long as possible under the restriction of the law, a boom foot mounting point on the upper pivotal body 3, that is, the boom foot pin 3*a*, at a position of the upper pivotal member which is as rearwards as possible. In this instance, however, there are the following problems.

In particular, if the boom foot mounting point is displaced rearwardly, then the guide sheaves 6 and 7 are also displaced rearwardly, and consequently, the winch drums 4 and 5 must also be displaced rearwardly. Accordingly, a rear end of the upper pivotal body 2, that is, a rear end of the counterweight 8, is displaced rearwardly by a distance equal to the distance over which the boom foot mounting point is displaced rearwardly. However, with the conventional wheel crane, the distance $l_1$ from the base end of the boom 3 to the rear end of the pivotal body 2 is great due to the fact that, (a) since the guide sheaves 6 and 7 and the winch drums 4 and 5 are both disposed in a juxtaposed relationship in the forward and backward directions, the winch frame 2*b* for accommodating the drums 4 and 5 has a great length in the rearward direction; and (b) since the boom foot mounting point (boom foot pin 3*a*) on the pivotal body 2 is located intermediately in the vertical direction when the boom 3 is in a horizontal position at the base end portion thereof, a great distance must be provided between the base end of the boom 3 and the front guide sheave 6 in order to avoid possible interference between them when the boom 3 is pivoted uprightly.

Therefore, if the boom foot mounting point is displaced rearwardly further, then the distance $l_2$ from the center 0 of pivotal motion of the boom 3 to the rear end of the pivotal body 2, that is, the maximum diameter of pivotal motion of the upper pivotal body 2, becomes excessively great, and consequently, the operability in a narrow location is deteriorated. This is a very serious drawback with a rough terrain crane with which great importance is attached to the operability at a narrow location.

By the reason described just above, it is considered impossible with a conventional wheel crane to displace the boom mounting point rearwardly from a current position.

Further, as a result, the boom foot mounting point is currently positioned forwardly of the center of a rear axle 1*a* of the lower running body 1 as shown in FIG. 3. Since, according to the layout, there are several problems in that the safety in running is deteriorated by imbalance between loads to the front and rear axles upon running and so forth, a conventional crane employs, as a countermeasure, means for increasing the thickness of the counterweight 8 to increase the weight of the counterweight 8. However, since this increases the maximum radius of pivotal motion, it is necessary to displace the winch box 2*b* forwardly by a distance corresponding to the amount of increase in thickness of the counterweight 8. This is also a factor which obstructs displacement of the boom foot mounting point.

From such circumstances as described above, it is considered actually impossible with a conventional wheel crane to increase the length of a boom further than the current length of the boom.

SUMMARY OF THE INVENTION

It is an object of the present invention to provide a wheel crane wherein the maximum radius of pivotal motion of a boom is minimized and the boom foot mounting point can be positioned as rearwards as possible to realize an increase of the boom length.

In order to attain the object, according to the present invention, there is provided a wheel crane which comprises a lower running body, an upper pivotal body carried on the lower running body, a boom mounted for up and down pivotal motion around a boom foot pin on the upper pivotal body, at least two winch drums disposed at a rear location of the pivotal body, and at least two guide sheaves disposed at another rear location of the pivotal body for guiding ropes drawn out from the winch drums individually to the rear face side of the rear end of the boom via the base end side of the boom, the boom foot pin being mounted at an end portion of the base end portion of the boom on the rear face side of the boom, the boom foot pin being mounted at a location of the upper pivotal body rearwardly of the center of a rear axle of the lower running body, the at least two guide sheaves and winch drums being respectively mounted in a left and right juxtaposed relationship at locations of the upper pivotal body nearest to the base end of the boom within a range wherein the guide sheaves and winch drums are not contacted with the base end of the boom when the boom is pivoted upwardly, and the locations of rear ends of the at least two guide sheaves being substantially coincident to the position of the rear end of the upper pivotal body in the forward and backward directions.

With the wheel crane of the construction described above, a spacing which should be assured rearwardly of the base end of the boom for up and down pivotal motion of the boom and another spacing which should be assured for the guide sheaves and the winch drums between the base end of the boom and the rear end of the pivotal body in the forward and backward directions can be reduced, and the thickness of a counterweight can be reduced. Consequently, the position of the rear end of the pivotal body can be set at a forward location, and accordingly, the distance from the base end of the boom to the rear end of the pivotal body can be reduced. As a result, it is possible to position the boom foot mounting point at a more rearward location compared with the conventional crane while the maximum radius of pivotal motion is restricted to a small extent.

Since, according to the present invention, an increase in length of the boom can be realized while restricting the maximum radius of pivotal motion, the operability at a narrow location is improved, and besides it is possible to expand the lift stroke and the operation radius to increase the utility of the crane by means of the thus elongated boom. Or where the length of the boom is equal to that of the conventional crane, the extent of a forward extension of the boom can be reduced, the front field of view of a driver can be improved, which contributes to improvement in safety in running and reduction in fatigue of the driver. Besides, since the elongation of the boom can be attained by the unique arrangement of the boom foot mounting point, winch drums and guide sheaves and no special structure is additionally provided according to the present invention, the structure is simple and the production cost is low.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
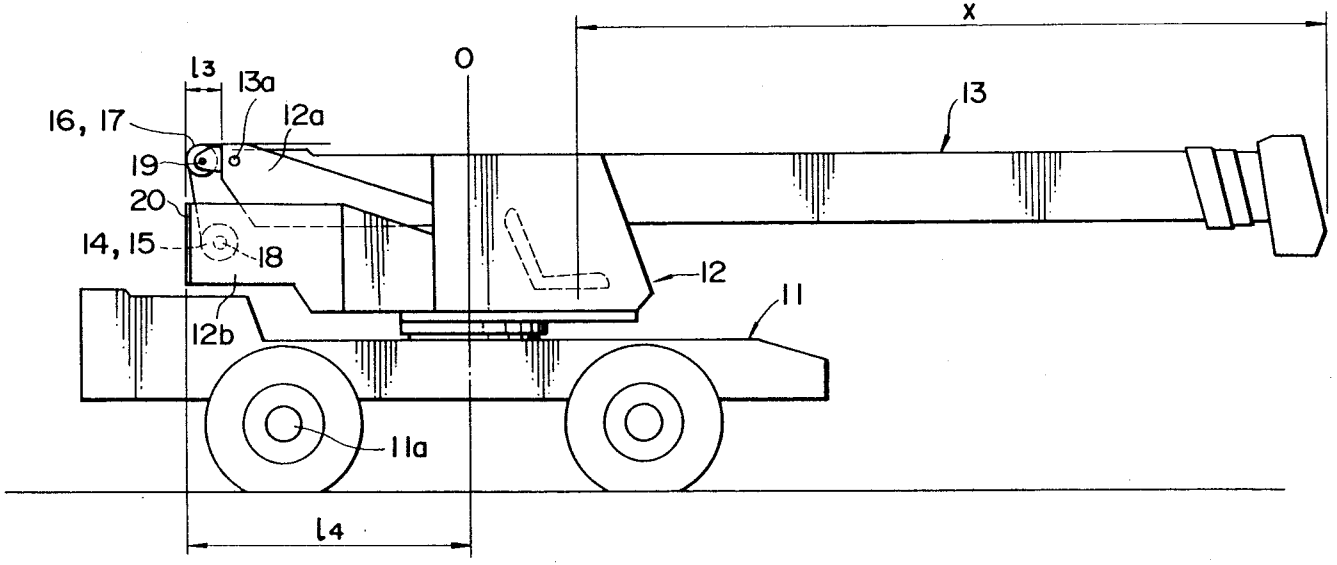
FIG. 1 is a side elevational view of a wheel crane in the form of a rough terrain crane showing an embodiment of the present invention.
Figure 2:
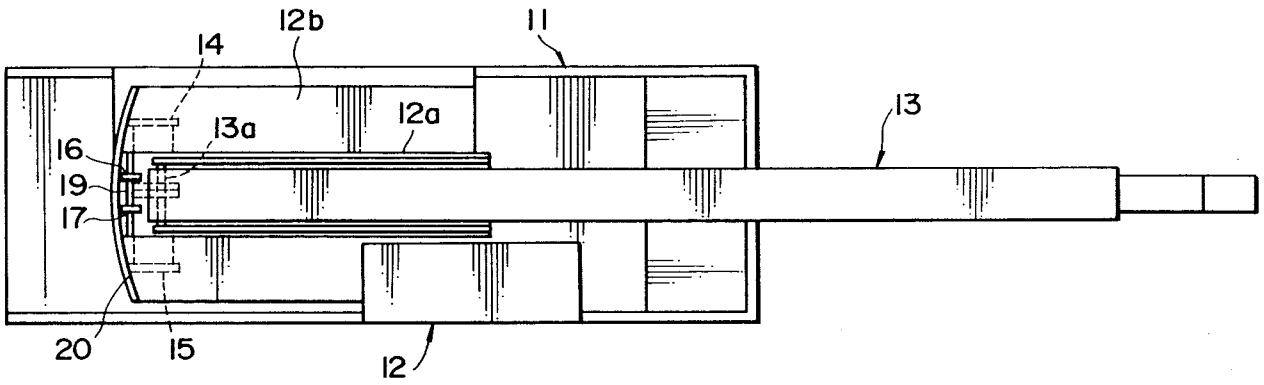
FIG. 2 is a plan view of the wheel crane shown in FIG. 1.

Referring to FIGS. 1 and 2, there is shown a wheel crane in the form of a rough terrain crane to which the present invention is applied. The wheel crane shown includes a lower running body 11, an upper pivotal body 12, and a boom 13 mounted at a rear face side of a rear end portion of a base end thereof (that is, an upper end portion thereof in the horizontal position of the boom 13) for pivotal motion on a rear end portion of a pivotal body main frame **12*a* by means of a boom foot pin 13*a*. As the boom foot mounting point (boom foot pin 13*a*) is positioned at the rear face side of the rear end portion of the base end portion of the boom 13 in this manner, the spacing which must be provided rearwardly of the base end of the boom 13 for up and down pivotal motion of the boom 13** is minimized.

The boom foot pin **13*a* is positioned adjacent an upper side of the boom, this being made possible by the fact that the guide sheaves 16 and 17 are substantially horizontally aligned with the boom foot pin. This means that the sheaves 16 and 17** will pivot downwardly and forwardly as the boom is being raised during use, so that their rearward extension is reduced.

The wheel crane further includes a pair of winch drums 14 and 15 accommodated in a winch frame **12*b* of the upper pivotal body 2, and a pair of guide sheaves 16 and 17 mounted at a rear end portion of the pivotal body main frame 12*a* rearwardly of the boom 13. The winch drums 14 and 15 and the guide sheaves 16 and 17 are individually mounted in a left and right juxtaposed relationship and have respectively mounted thereon a guide shaft 18 and a sheave shaft 19. Since the winch drums 14 and 15 and the guide sheaves 16 and 17** are provided in a left and right juxtaposed relationship with the same shafts mounted thereon in this manner, the spacing which are occupied by those elements in the forward and backward directions can be reduced significantly comparing with the conventional crane wherein such elements are disposed in a juxtaposed relationship in the forward and backward directions.

Meanwhile, the winch drums 14 and 15 and the guide sheaves 16 and 17 are mounted nearest to the base end of the boom 13, that is, at a position as forward as possible within a range in which they do not contact nor interfere with the base end of the boom 13 when the boom 13 is pivoted upwardly.

Figure 3:
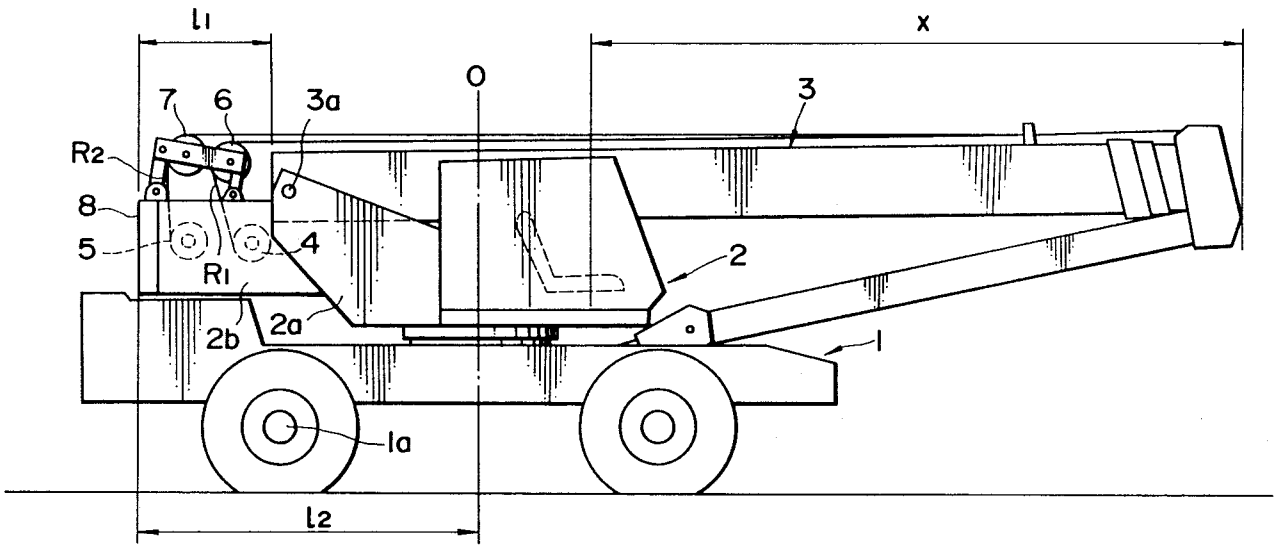
FIG. 3 PRIOR ART
FIG. 3 is a side elevational view showing a conventional wheel crane.

According to the arrangement of the boom foot mounting point, winch drums 14 and 15 and guide sheaves 16 and 17, the boom mounting point can be displaced rearwardly and the rear end of the pivotal body 12 (rear end of a counterweight 20) can be displaced forwardly compared with the conventional crane shown in FIG. 3. As a result, with the present wheel crane, the boom foot mounting point is positioned rearwardly of the center of a rear axle **11*a* of the lower running body 11 while the rear ends of the guide sheaves 16 and 17 and the rear end of the pivotal body 12 substantially coincide with each other (either coincide exactly with each other or coincide with each other with a small distance left therebetween) in the forward and backward directions. In other words, since it is possible to displace the boom foot mounting point rearwardly to a position rearwardly of the center of the rear axle, loads on the front and rear axles upon running of the wheel crane can be equalized. Consequently, it is possible to reduce the thickness and hence the weight of the counterweight 20, and accordingly, it is possible to displace the rear end of the pivotal body further forwardly until it substantially coincides with the rear ends of the guide sheaves 16 and 17**.

With the construction described above, the distance $l_3$ from the base end of the boom 13 to the rear end of the pivotal body 12 (rear ends of the guide sheaves 16 and 17) and the distance (maximum radius of pivotal motion) $l_4$ from the center of pivotal motion of the pivotal body 12 to the rear end of the pivotal body 12 can be reduced significantly comparing with the corresponding distances $l_1$ and $l_2$ of the conventional crane described hereinabove. In other words, while the maximum radius $l_4$ of pivotal motion is restricted, the length of the boom 13 can be increased.

What is claimed is:

1. A wheel crane, comprising:

a lower running body having a front and rear end, an upper pivotal body pivotally mounted on said lower running body and having a front end and a rear end, a cabin mounted on said upper pivotal body for use in operating and travelling said wheel crane;

a boom having a base end mounted for up and down pivotal motion around a boom foot pin on said upper pivotal body and being telescopically extensible at a front end thereof opposite a rear end thereof, at least two winch drums disposed at a rear location of said pivotal body, and at least two guide sheaves disposed at another rear location of said pivotal body for guiding ropes drawn out from said winch drums individually to a rear face side of said rear end of said boom via the base end of said boom, said boom foot pin being mounted at an end portion of said base end of said boom on the rear face side of said boom, and adjacent an upper side of said boom, said boom foot pin being mounted at a location of said upper pivotal body rearwardly of the center of a rear axle of said lower running body, said at least two guide sheaves and said at least two winch drums being respectively mounted in a left and right juxtaposed relationship at locations of said upper pivotal body nearest to the base end of said boom within a range wherein said guide sheaves and winch drums are not contacted with the base end of said boom when said boom is pivoted upwardly, wherein said guide sheaves are substantially horizontally aligned with said boom foot pin, and the locations of rear ends of said at least two guide sheaves being substantially coincident to the position of the rear end of said upper pivotal body in forward and backward directions.

2. The wheel crane of claim 1 including a single shaft mounted on all of said winch drums.

3. The wheel crane of claim 1 includes a single shaft mounted on all of said guide sheaves.

* * * * *